US006318584B1

(12) United States Patent
Milan

(10) Patent No.: US 6,318,584 B1
(45) Date of Patent: Nov. 20, 2001

(54) BEVERAGE CONTAINER LID HAVING BAFFLE ARRANGEMENT

(76) Inventor: Michael Milan, 29715 Zuma Bay Way, Malibu, CA (US) 90265

( * ) Notice: Subject to any disclaimer, the term of this patent is extended or adjusted under 35 U.S.C. 154(b) by 0 days.

(21) Appl. No.: 09/611,074

(22) Filed: Jul. 6, 2000

(51) Int. Cl.[7] ..... A47G 19/22

(52) U.S. Cl. ..... 220/713; 229/404; 215/387; 220/719; 220/367.1; 220/711; 220/374; 220/255

(58) Field of Search ..... 220/256, 255, 220/367.1, 373, 374, 711, 713, 719, 731; 229/404; 215/387; 222/547, 564

(56) References Cited

U.S. PATENT DOCUMENTS 3,360,161 * 12/1967 Smith .
4,322,014 * 3/1982 Philip .
4,331,255 5/1982 Fournier .
4,460,101 7/1984 Tseng .
4,795,052 1/1989 Hayes, Jr. .
5,143,248 9/1992 Sawatsky .
5,540,350 * 7/1996 Lansky .
5,979,689 * 11/1999 Lansky .
6,220,476 * 4/2001 Waller .

* cited by examiner

*Primary Examiner*—Allan N. Shoap
*Assistant Examiner*—Robin A. Hylton
(74) *Attorney, Agent, or Firm*—Jack C. Munro

(57) ABSTRACT

A removable beverage container lid for a beverage container to cover the mouth of the beverage container wherein the lid has a substantially enclosed space defined between an exterior cover and an interior cover. An inlet opening is formed with the interior cover through which a hot beverage is to flow into the substantially enclosed space. Attached to the interior cover at the forward edge of the inlet opening is a partition with the height of the partition extending to be located substantially against the exterior cover. The length of the partition is at least equal to the length of the inlet opening. Between the partition and the peripheral edge of the exterior cover is located a gap area. Connected with the gap area is a dispensing opening formed within the exterior cover. Hot beverage is required to flow around the partition and into the gap area prior to flowing through the dispensing opening exteriorly of the beverage container.

6 Claims, 1 Drawing Sheet

BEVERAGE CONTAINER LID HAVING BAFFLE ARRANGEMENT

BACKGROUND OF THE INVENTION

1) Field of the Invention

The subject matter of this invention is directed to a removable lid for a beverage container and more particularly to a lid that is designed to minimize the possibility of burning ones mouth and also substantially prevent accidental spillage of the liquid beverage from the beverage container.

2) Description of the Prior Art

It is exceedingly common within the present day society to utilize beverage containers that are made of paper and plastic that are intended to be used once and then disposed. It is also exceedingly common for individuals to utilize these disposable beverage containers to contain hot beverages such as coffee, tea and hot chocolate. It is common that an individual is mobile while consuming of the beverage as the individual may be walking from one location to another, riding in a car or doing some other activity other than merely sitting. It is common to have a lid substantially enclose the open mouth of the beverage container. The primary function of the lid is to prevent leakage of the beverage which can easily occur when the consumer is moving from location to another or riding in a car. The movement of the car or the movement of the consumer can cause the beverage to move within the beverage container and be squirted out through the dispensing opening formed within the lid. This spilling of the beverage can be deposited on the consumer's hands and clothing or on articles contained near the consumer, such as on a desk.

Another problem associated with lids of the past is that the hot liquid is dispensed directly from the beverage container, through the dispensing opening into the consumer's mouth. Frequently, the hot liquid is at such an elevated temperature that it can actually cause a burn to occur on the lips of the consumer and within the mouth of the consumer. In the past, there has not been made any effort to construct lids to substantially eliminate this possibility of the consumer being burned.

SUMMARY OF THE INVENTION

A beverage container lid which has an exterior cover and an interior cover, both of which are discoid shaped. The peripheral edge of the interior cover is permanently secured to the peripheral edge of the exterior cover. Located between the interior cover and the exterior cover is a substantially enclosed space. The peripheral edge of the exterior cover is to be removably mounted over the mouth of a beverage container with the liquid of the beverage container to be capable of being moved through an inlet opening formed within the interior cover to then be contained within the substantially enclosed space. The inlet opening is non-centrally located within the interior cover with the forward edge of the inlet opening being located substantially closer to the peripheral edge than the rearward edge of the inlet opening. A partition is attached to the interior cover and is located within the substantially enclosed space. The partition has a top edge which is to be located in contact with the interior surface of the exterior cover. The length of the partition is to be at least equal to the length of the inlet opening which requires that the beverage that passes through the inlet opening must pass around the partition to be located within a gap area defined as being part of the substantially enclosed space. A dispensing opening is formed within the exterior cover and is aligned with the gap area. The beverage from the gap area is to be dispensed exteriorly of the beverage container through this dispensing opening by tilting of the beverage container.

The primary objective of the present invention is to construct a beverage container lid which substantially eliminates the possibility of spillage of the beverage from the beverage container upon the beverage container encountering a sudden movement.

Another objective of the present invention is to construct a beverage container lid which substantially eliminates the possibility of a hot beverage burning of the consumer's lips or mouth during consuming of the hot beverage.

Another objective of the present invention is to construct a beverage container lid which can be constructed inexpensively and therefor sold to the ultimate consumer at a relatively inexpensive price.

Another objective of the present invention is to construct a beverage container lid which is simple in construction and therefore non-complex to manufacture.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE PREFERRED EMBODIMENT

Figure 1:
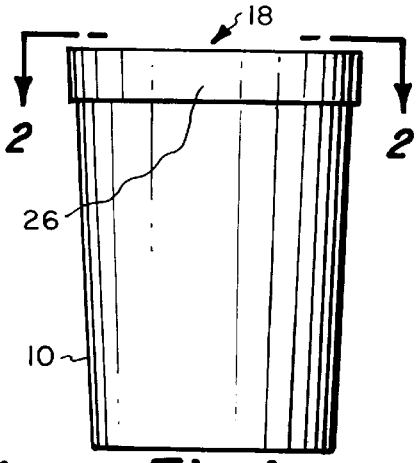
FIG. 1 is an exterior view of a typical beverage container on which has been installed the beverage container lid of the present invention.
Figure 2:
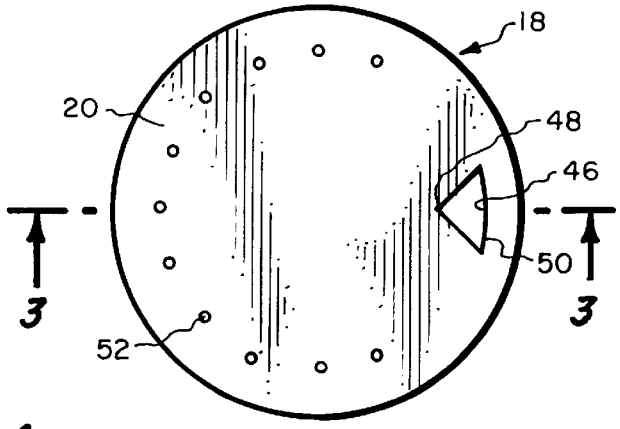
FIG. 2 is a top plan view of the beverage container lid of the present invention taken along line 2—2 of FIG. 1.
Figure 3:
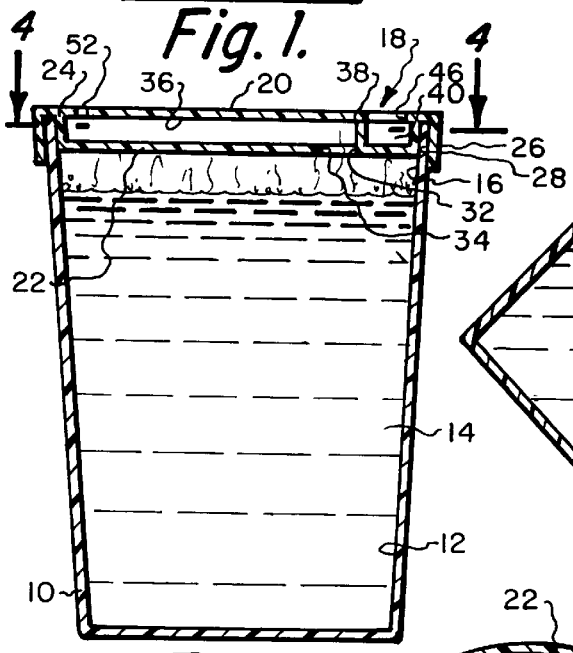
FIG. 3 is a cross-sectional view through the beverage container and the beverage container lid of this invention taken along line 3—3 of FIG. 2 showing the beverage container in a normal resting upright position.

Referring particularly to the drawing, there is shown in FIG. 1 a beverage container 10 that has an internal chamber 12. Within the internal chamber 12 there is to be located a quantity of a beverage 14. The beverage container 10 has an open mouth 16. A typical beverage could be a cold beverage or a hot beverage. However, the structure of the present invention is designed in particular to be used in conjunction with a hot beverage such as tea, coffee or hot chocolate.

The open mouth 16 is to be closeable by a lid 18. The lid 18 is to be constructed of plastic or other similar type of sheet material such as a paper composition. The lid 18 has an exterior cover 20 and an interior cover 22. Both the exterior cover 20 and the interior cover 22 are of a discoid shape and are both substantially planar. However, it is to be within the scope of this invention that the covers 20 and 22 could be other than a discoid shape, such as for an example a square shape or another polygonal shape such as hexagonal or octagonal. Typically, the thickness of the covers 20 and 22 will generally by about one-eighth of an inch.

The interior cover 22 has a peripheral edge which is formed into an annular flange 24. The upper edge of the annular flange 24 is glued or otherwise fixedly secured, as by heat sealing, to the inside surface of the exterior cover 20. Integrally connected to the peripheral edge of the exterior cover 20 is an annular depending flange 26. In between the depending flange 26 and the annular flange 24 is located an annular groove 28. The upper edge of the beverage container 10 located at the open mouth 16 is to be snugly located within the annular groove 28. This will fixedly secure the lid 18 onto the beverage container 10. However, the lid 18 can be manually disengaged from the beverage container 10 by merely pulling of the lid 18 away from the beverage container 10.

Figure 5:
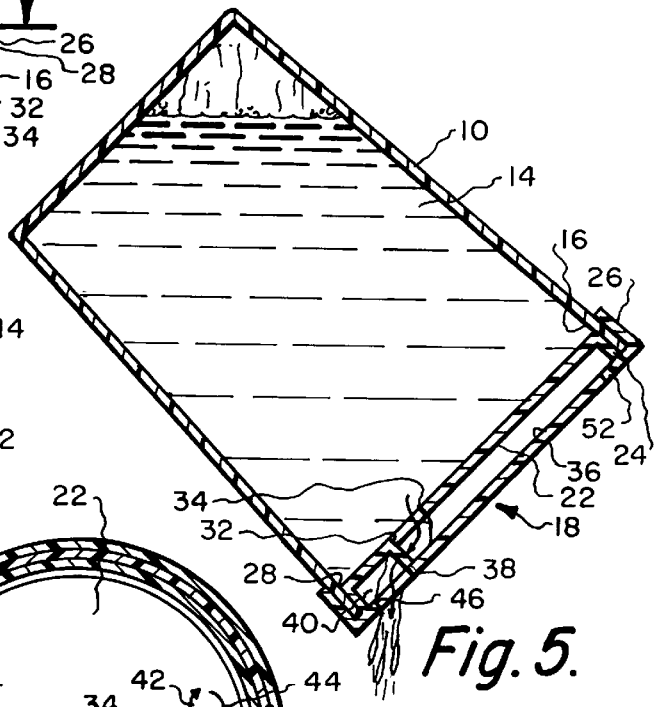
FIG. 5 is a view similar to FIG. 3 but showing the beverage container in the typical tilted position for consuming of the beverage contained within the beverage container.

The interior cover 22 includes an inlet opening 30. The inlet opening 30 is generally no more than three quarters of an inch to one inch in length and about one quarter of an inch wide. The inlet opening 30 is located in an off center position within the interior cover 22. The inlet opening 30 has a forward edge 32 and a rearward edge 34. Upon tilting of the beverage container 10 to a tilted position, such as depicted within FIG. 5, a small quantity of the beverage 14 is to flow through the inlet opening 30 to within the substantially enclosed space 36 formed between the exterior cover 20 and the interior cover 22.

Fixedly mounted onto the upper surface of the interior cover 22 at the forward edge 32 is a partition 38. The partition 38 has a top edge that is to be in contact with the interior surface of the exterior cover 20. The partition 38 comprises an arcuately shaped wall that is about three quarters to an inch long with it be important that the partition 38 be at least as long as the length of the inlet opening 30. Actually, the partition 38 comprises the "punched out" material of interior cover 12 that forms inlet opening 30. In between the partition 38 and the annular flange 24 is a gap area 40. It is to be noted that the gap area 40 is generally no more than a quarter to a half inch wide. This means the partition 38 is located very near the annular flange 24 with there being a substantial amount of space from the rearward edge 34 to the annular flange 24. The reason for this is so that when the beverage container 10 is tilted the beverage 14 will flow through the inlet opening 30, depicted by arrows 42, to against the partition 38 and then around the partition 38 as shown by arrows 44 to within the gap area 40.

Connecting with the gap area 40 is a dispensing opening 46, which is shown to be of a triangular configuration. The consumer is to locate his or her mouth about the dispensing opening 46 with the upper lip being located in the area of the point 48 and the bottom lip located close to but spaced from the base 50. The point 48 prevents the beverage, if hot, from contacting to any great extent the upper lip of the consumer. This is so as to protect the upper lip against burning. Although the fact that the beverage has to travel some distance, that is from the inlet opening 30, around the partition 38, to within the gap area 40 prior to being dispensed through the dispensing opening 46. This distance of travel should be sufficient enough to substantially cool the beverage and prevent burning of any portion of the consumer's mouth. Also, the vent holes 52 help to cool the beverage by letting "steam" escape into the ambient.

If the beverage container 10 is jostled or inadvertently tipped over, the fact that the beverage 14 must be conducted through the inlet opening 30 and then through the dispensing opening 46 substantially minimizes the possibility of any accidental dispensing of the beverage 14. The vent holes 52 are so small that a minimal amount of beverage could flow through these holes 52 into the ambient if the beverage container 10 is tipped over. The purpose of this is to prevent contamination of the consumer's workplace as well as the consumer's clothes and contact with the consumer's person.

Figure 4:
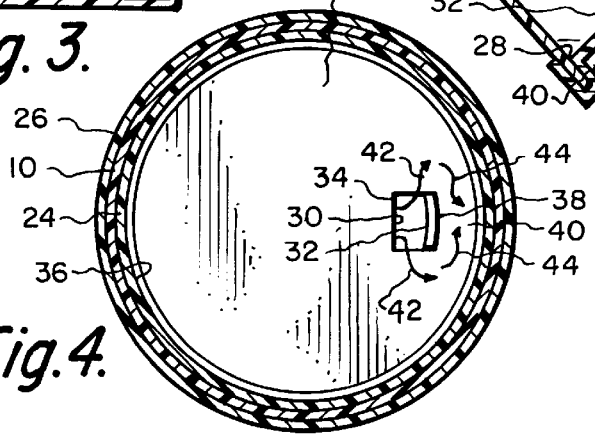
FIG. 4 is a view partly in cross-section through the beverage container lid of the present invention taken along line 4—4 of FIG. 3.

Although the partition 38 is shown to be of an arcuate configuration which is believed to help in directing the beverage 42 in the direction of arrows 42, it is considered to be within the scope of this invention that the partition 38 could be of another configuration, such as a straight configuration or possibly even a convex configuration rather than concave shown in FIG. 4.

The present invention may be embodied in other specific forms without departing from the essential attributes thereof. Reference should be made to the appending claims rather than the foregoing specification as indicating the scope of the invention.

What is claimed is:

1. A beverage container lid comprising:

an exterior cover and an interior cover, said interior cover having a peripheral edge which is secured to said exterior cover forming a substantially enclosed space between said interior cover and said exterior cover, said lid adapted to be installed over an open mouth of a beverage container which contains a beverage;

an inlet opening formed within said interior cover, said inlet opening having a forward edge and a rearward edge, said inlet opening being non-centrally located within said interior cover with said forward edge located substantially closer to said peripheral edge than said rearward edge, said inlet opening adapted to permit flow of the beverage from the beverage container into said substantially enclosed space;

a partition attached to said interior cover at said forward edge and extending to contact said exterior cover, whereby the beverage that flows through said inlet opening must flow around said partition into a gap area which is part of said substantially enclosed space; and a dispensing opening formed within said exterior cover, said dispensing opening adapted for dispensing of the beverage from the beverage container, said dispensing opening being aligned with said gap area, whereby tilting of the beverage container the liquid beverage must flow through said inlet opening and around said partition and then through said dispensing opening which will function to cool the beverage if such is a hot beverage.

2. The beverage container lid as defined in claim 1 wherein:

said inlet opening having a length, said partition being at least as long as said length so that all of the beverage that flows through said inlet opening must flow around said partition and not directly from said inlet opening into said gap area.

3. The beverage container lid as defined in claim 1 wherein:

said inlet opening being located directly adjacent said dispensing opening.

4. The beverage container lid as defined in claim 1 wherein:

said dispensing opening being triangularly shaped having a base, said base being located in substantial alignment with said peripheral edge, whereby an angle of the triangularly shaped dispensing opening will be located at an upper lip area of the user which is to minimize contact of a hot beverage with the upper lip area.

5. The beverage container lid as defined in claim 1 wherein:

said partition having a top edge which is to be located in contact with said exterior cover, said partition being arcuately shaped when observed at said top edge.

6. The beverage container as defined in claim 1 wherein:

said exterior cover having at least one vent opening for releasing of steam from the beverage contained within said enclosed space.

* * * * *